US006328829B1

(12) United States Patent
Kato et al.

(10) Patent No.: US 6,328,829 B1
(45) Date of Patent: Dec. 11, 2001

(54) CONSTRAINED HARDENING METHOD AND APPARATUS FOR DEFORMED BAR WORKPIECES

(75) Inventors: Junichi Kato; Yoshiki Seto; Tetsukazu Fukuhara; Yugo Yao, all of Hiratsuka (JP)

(73) Assignee: Neturen Co., Ltd., Tokyo (JP)

( * ) Notice: Subject to any disclaimer, the term of this patent is extended or adjusted under 35 U.S.C. 154(b) by 0 days.

(21) Appl. No.: 09/411,204

(22) Filed: Oct. 4, 1999

(30) Foreign Application Priority Data

Oct. 12, 1998 (JP) ..... 10-303202

(51) Int. Cl.[7] ..... C21D 1/673

(52) U.S. Cl. ..... 148/647; 148/645; 148/646; 266/117; 266/259; 266/260

(58) Field of Search ..... 148/645, 646, 148/647; 266/259, 260, 117

(56) References Cited

U.S. PATENT DOCUMENTS 5,492,308 * 2/1996 Yao et al. ..... 266/117
5,626,693 * 5/1997 Yao et al. ..... 213/892

FOREIGN PATENT DOCUMENTS 31 11 705 10/1982 (DE) .
0 628 641 12/1994 (EP) .
0 632 137 1/1995 (EP) .
0 754 771 1/1997 (EP) .
54-67504 5/1979 (JP) .
358050144A * 3/1983 (JP) ..... B21H/9/02
407098021A * 4/1995 (JP) ..... F16D/1/10
09071819 3/1997 (JP) .
10-158742 6/1998 (JP) .

OTHER PUBLICATIONS

The Making, Shaping and Treating of Steel, 1985, United States Steel, 10th Edition, p. 795.*

* cited by examiner

*Primary Examiner*—Roy King
*Assistant Examiner*—Harry D. Wilkins, III
(74) *Attorney, Agent, or Firm*—Wenderoth, Lind & Ponack, L.L.P.

(57) ABSTRACT

Hardening is accomplished by heating a longitudinal section of a workpiece such as an odd-shaped bar, and by quenching while constraining the workpiece section in dies. The quenching is executed while the workpiece is pressed in a direction perpendicular to its longitudinal direction by a pressing device which is installed adjacent to the workpiece section constrained in the dies. Warping by quenching can thus be minimized in odd-shaped workpieces, such as an automobile steering rack bar.

13 Claims, 8 Drawing Sheets

CONSTRAINED HARDENING METHOD AND APPARATUS FOR DEFORMED BAR WORKPIECES

BACKGROUND OF THE INVENTION

The present invention relates to constrained hardening of bar-shaped workpieces for preventing warping. In particular, this invention is directed to a hardening method and apparatus suitable for odd-shaped workpieces such as steering rack bars for automobiles which have a tendency to warp during hardening.

Hardening of bar shaped machinery parts is very popular. In order to harden axially symmetrical parts such as a body of simple revolution, rotation around the axis during quenching for equalization of cooling is adopted for prevention of warping. Moreover prevention of warping by exerting constraining force is also adopted. For example, a round bar is rotated among three rolls extending therealong during quenching as shown in Japanese laid-open patent No. Sho 54-67504.

However, bar workpieces having a deformed (odd) shape such as a bar workpiece having a rack gear along its side tend to bend by hardening because the cooling rate is not uniform about their axes. Moreover, these workpieces mentioned above cannot be rotated during quenching, so that press quenching is usually used for prevention of warping during hardening. In the press quenching, all or a part of a workpiece heated to an appointed hardening temperature is held in a set of dies having determined cavities. Then the workpiece is cooled down under pressure by a method such as immersing into a cooling liquid tank.

Recently there has been a trend of cutting weight of automobiles by hollowing such aforementioned bar parts with a rack gear along its side to form pipe parts. However, the pipe parts are very liable to create bending during the hardening process compared with solid bars. Moreover, the pipes could be collapsed by a pressing force in the aforementioned press quenching. If the pressing force is limited for preventing collapse, warping might not be suppressed and strain might arise when being pressed in the dies after being cooled down. Moreover, even if the pressing force is considerably increased and the workpiece is made straight in the dies, warping might arise by existence of residual stress as the workpiece is taken out from the dies. Such residual stress is usually controlled by regulating a cooling rate by partly changing a cooling liquid amount blown against a workpiece depending on the workpiece shape. However, occurrence of warping is not so simple as it changes depending on steel constituents in relation to transformation temperature, because strain during the hardening process is a sum of thermal strain and transformation strain.

SUMMARY OF THE INVENTION

As explained above in some cases (especially in hollowed deformed-shape workpieces), warping cannot be suppressed merely by pressing between dies because of limited pressing force. Moreover, even if deformation is thoroughly suppressed within the dies, warping might occur by residual stress when the workpiece is taken out from the dies. Therefore, complete prevention of warping is difficult as matters now stand. The present invention is intended to minimize warping during hardening of odd-shaped bar workpieces which are difficult to prevent from warping completely in prior constrained hardening processes by dies.

Namely, the present invention is a hardening method which include heating a section of a workpiece of an odd-shaped bar and quenching while constraining the workpiece; section in dies. The quenching is executed while the workpiece is being pressed in at direction perpendicular to its longitudinal direction by a pressing means which is installed adjacent to at least one side of the workpiece section constrained in the dies. Moreover, this invention includes a method in which test quenching is executed while the pressing means is retracted from the workpiece. Proper quenching is then executed while setting the pressing means in a pressing direction, and in at least one of a pressing stroke and a pressing force, so as to reform bending that occurs in the test quenching. By this method, bending in the workpiece can be minimized after hardening.

Moreover, the present invention is a constraining quenching apparatus for quenching a section of a workpiece being constrained in dies, comprising a pressing means which is installed adjacent to at least one side of the workpiece section constrained in the dies. The pressing means comprises at least one pressing member which presses around the workpiece in a direction perpendicular to its longitudinal direction. Each of the pressing members comprises a pressure regulating means for regulating at least one of a pressing stroke and a pressing force independently during pressing conditions by the dies.

In another embodiment of the apparatus, this invention is a constraining quenching apparatus for quenching a longitudinal section of a workpiece being constrained in dies, comprising a pressing means which is connected to the dies at a place adjacent to at least one side of the workpiece section constrained in the dies. The pressing means comprises at least one pressing member which presses around the workpiece in a direction perpendicular to its longitudinal direction. Each of the pressing members comprises an advance-and-retreat position regulating means for regulating a pressing stroke. In this apparatus, the advance and-retreat position regulating means may comprise the pressing member being threaded, whereby the pressing member moves in an advancing and retreating direction by rotation. Moreover, in each of the above apparatuses, the dies may have a plurality of projections defining a contour corresponding to a contour of the workpiece. Recesses are defined between the projections, and a cooling liquid spouting hole is provided at at least one of the recesses of each die.

Figure 8:
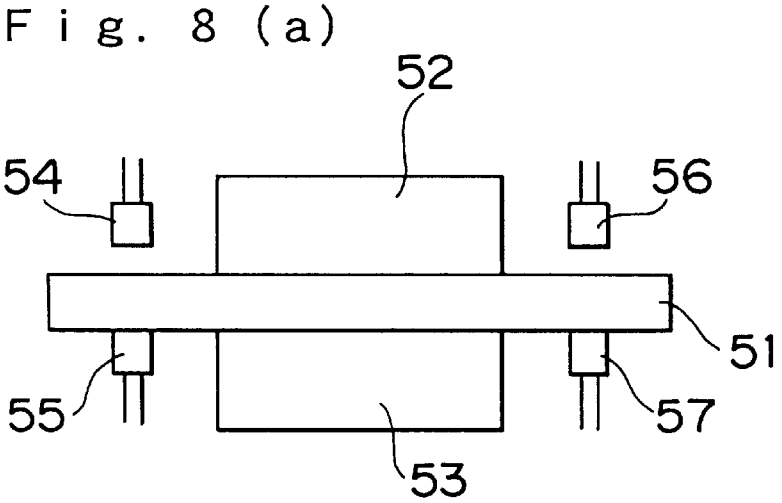
Figure 8:
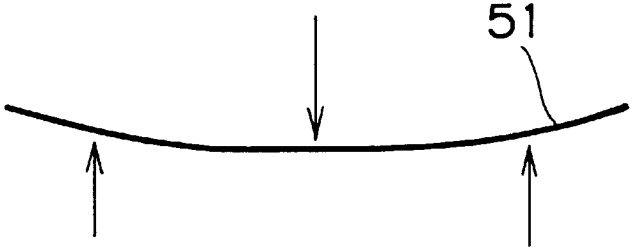
Figure 8:
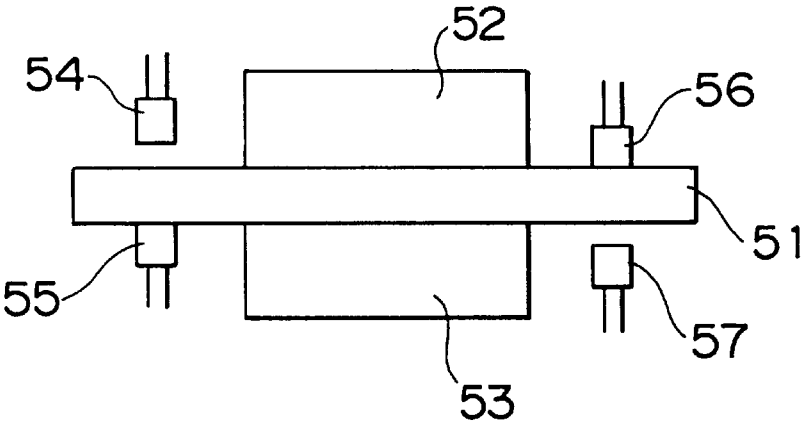
Figure 8:
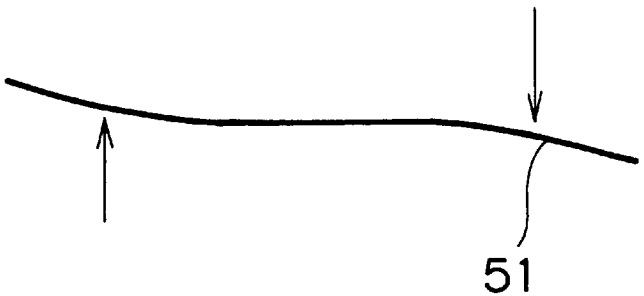

From FIG. 8(*a*) to FIG. 8(*d*) are drawings for explaining the effect of the constrained hardening method of this invention.

DETAILED DESCRIPTION OF THE PREFERRED EMBODIMENTS

In the present invention, as a constrained hardening method including heating a section of a workpiece formed as an odd-shaped bar and quenching the section of the workpiece in dies, not only a constraining force of the dies but also other forces are exerted for preventing warping during hardening. Namely, this invention intends to minimize occurrence of warping by exerting stress to the workpiece for extinguishing strain during a constrained quenching process as a positive means for controlling strain. As a method for attaining this, quenching is executed while the workpiece is pressed in a direction perpendicular to its longitudinal direction by a pressing means which is installed adjacent to one side or both sides of the workpiece section constrained in the dies.

Figure 1:
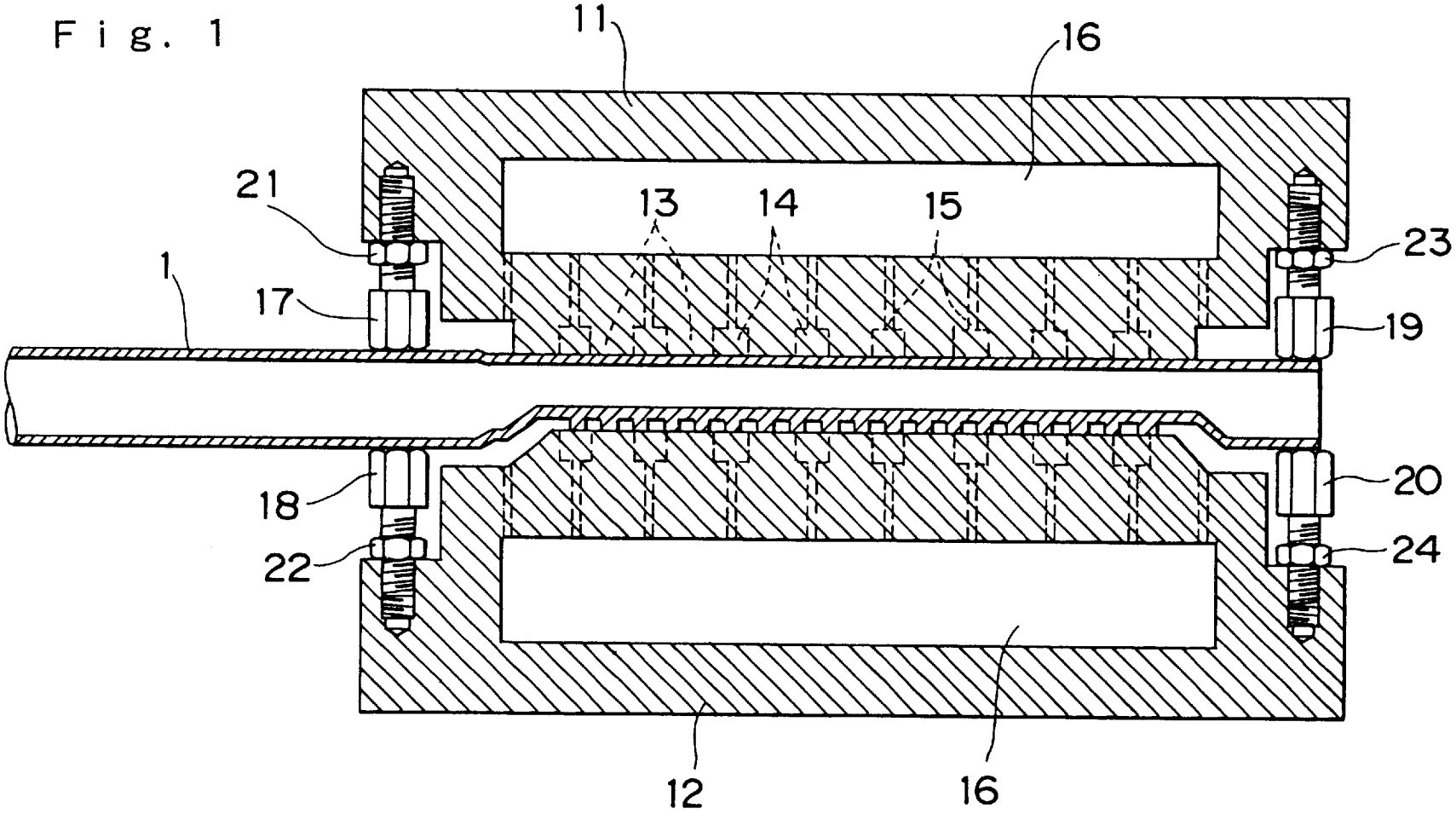
FIG. 1 is a cross-sectional side view of a portion of the present invention.
Figure 2:
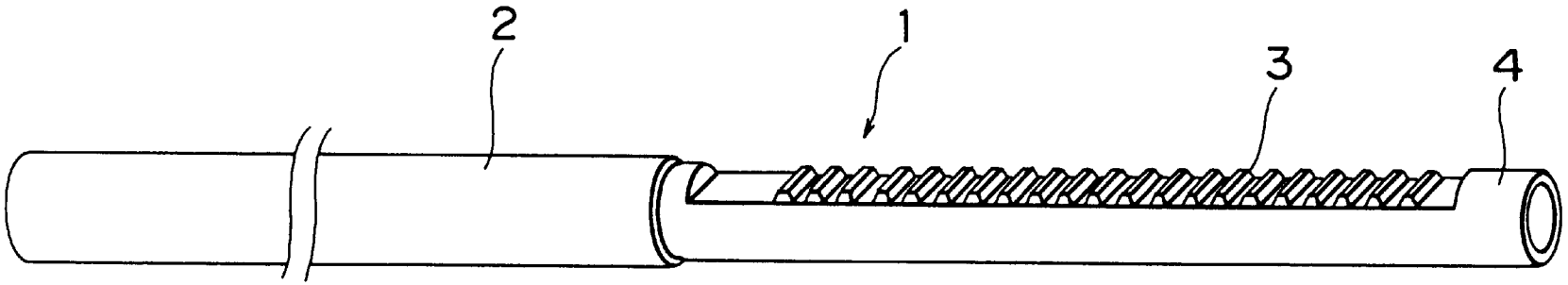
FIG. 2 is a perspective view of a rack bar as an example of a workpiece.

FIG. 1 is a cross-sectional side view of an example of the pressing device of the present invention wherein a workpiece is shown along its longitudinal axis FIG. 2 is a perspective view of a rack bar as a workpiece 1 in FIG. 1, where the length of the rack bar is composed of a fill-circle part 2 in which the cross section is a full circle, an odd-shaped part 3 in which the cross section is not a full circle, and a short full-circle part 4 which extends beyond the odd-shaped part 3. FIG. 1 shows a situation of quenching by spouting coolant as water after the odd-shaped part is heated, wherein this part is pressed by the dies 11 and 12 when the side formed rack is positioned facing downwards. Then, pressing means characteristic of this invention are connected to the dies 11 and 12 at a place adjacent to both sides of the workpiece part constrained in the dies. The pressing means comprise pressing members 17, 18, 19 and 20 which press the workpiece in a direction perpendicular to its longitudinal direction, namely, a vertical direction in this example.

The pressing means are adjacent to pressing parts of the dies which can be said to be substantial parts of the dies, so that a bending force can be exerted on the workpiece between the pressing means and the dies. Namely, this example has such construction by connecting the pressing members 17, 18, 19 and 20 to the dies 11 and 12 themselves. Each of the pressing members can move along advance-and-retreat directions so as to press the workpiece depending on demand. The parts of the workpiece which the pressing members contact are a full-circle part 2 and a short full-circle part 4 (FIG. 2) which are out of the zone heated for hardening. Therefore, the temperature of those parts is low and they have sufficient hardness, so that dents will not occur on the workpiece by pressure of the pressing members. Besides, in the above example, the pressing means are connected to both sides of the dies. However, one side of the pressing members, such as 19 and 20, can be omitted if only one side is necessary depending on the shape of a workpiece.

Figure 3:
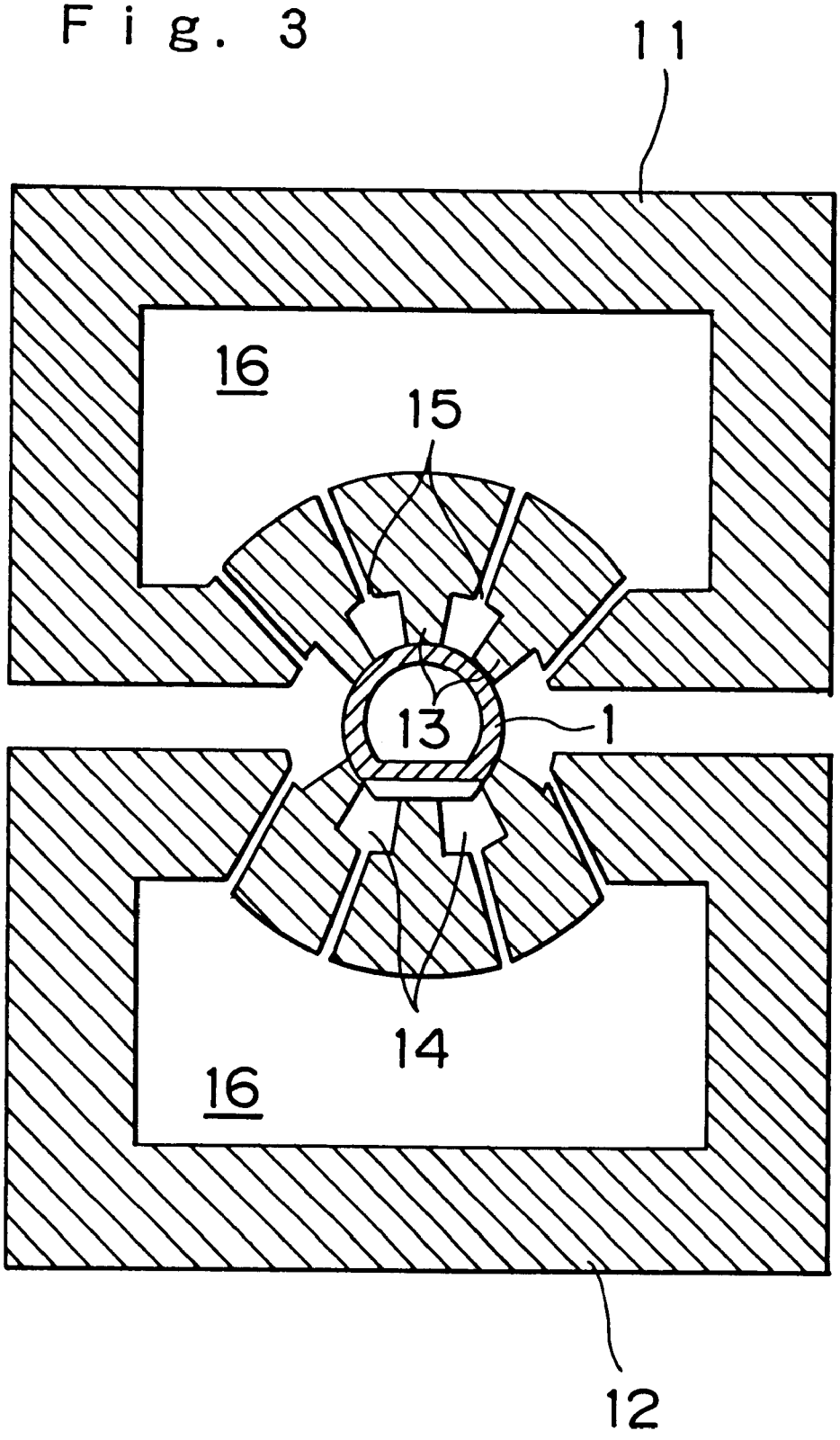
FIG. 3 and FIG. 4 are cross-sectional front views of the equipment shown in FIG. 1, respectively, taken at a dies portion and at a pressing means.

FIG. 3 is a cross-sectional front view of the pressing device shown in FIG. 1 wherein of the workpiece is shown perpendicular to its longitudinal axis. This drawing shows the substantial parts of the dies 11 and 12, however, the present invention does not restrict the construction of these parts. In this example, the dies comprise a plurality of projections 13 defining a, contour corresponding to a contour of the workpiece 1, and recesses 14 are formed between the projections as shown in FIG. 1 and FIG. 3. By corresponding the inner face of the dies, to a contour of a workpiece as shown above, the dies can deal with any direction of warping of the workpiece. In addition, if a workpiece is hollowed and thin which is easily collapsed by pressure, a method of prior invention of these inventors in U. S. Pat. No. 5,626,693 is recommended, wherein the pressure exerted by the dies 11 and 12 is varied during cooling in the hardening process.

There are cooling liquid spouting holes 15 in many places of the above-mentioned recesses 14 of the dies, through which cooling liquid is supplied from cooling liquid supplying rooms 16. If more than one cooling liquid spouting hole 15 is provided in the recesses 14 of each die 11 and 12, spouted cooling liquid will spread over the entire surface of the workpiece. Then a cooling rate can be controlled by proper allocation of the cooling liquid spouting holes. Namely, cooling is fast at the places exposed directly to cooling liquid jets, and contrarily cooling is relatively slow at the places cooled by flowing liquid dissipated through the recesses. By partially controlling a cooling rate in the workpiece as explained above, the cause of warping can be eliminated to some extent even in an odd-shaped workpiece as a rack bar, before the step of prevention of warping by constraining force.

Figure 4:
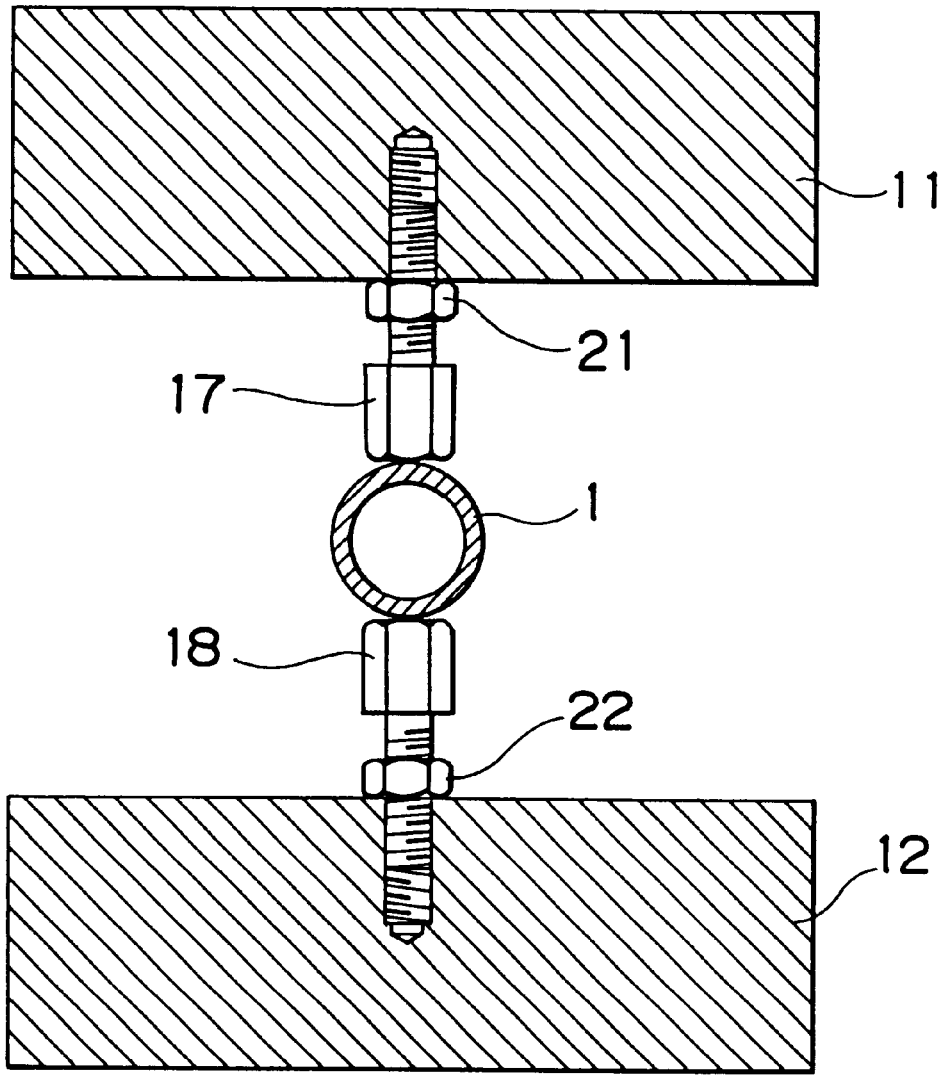

FIG. 4 is a cross-sectional front view of the equipment shown in FIG. 1 taken perpendicular to the length of the workpiece, wherein the workpiece is shown at a part of pressing means which is a characteristic part of this invention. In this drawing the pressing means are composed of two pressing members 17 and 18 and other parts. These pressing members are connected to the upper die 11 and the lower die 12, respectively, and move together with the dies. In this example a rack bar as the workpiece 1 is positioned so that the rack part faces downwards in the quenching process. Consequently, warping is presumed to arise only as a bend toward the vertical direction because of symmetry of the workpiece. Therefore, as one pressing device, there are two pressing members at the upper and lower sides of the workpiece, so that it is possible to exert a bending force only in a vertical direction. Namely, in this example there are a total of four pressing members, and two of them are shown in both FIG. 1 and FIG. 4 as 17 and 18, while the other two are shown only in FIG. 1 as 19 and 20.

Control of a pressing force is executed by varying the pressing stroke of the above-explained pressing members 17, 18, 19 and 20, namely by varying their protruding lengths when closing the dies so as to hold a workpiece. By this reason, the pressing member should be equipped with an advance-and-retreat position regulating means for regulating a pressing stroke. Because a range of the protruding length to be controlled is small (such as within 1 mm), it is recommended that the pressing member is a threaded mechanism for regulating small distances, so that the pressing member can move in advance and retreat directions by its rotation. The equipment shown in FIG. 1 and FIG. 4 has such a mechanism wherein the pressing members themselves are composed of hexagon-headed bolts and can move in advance and retreat directions by rotating. Part numbers 21, 22, 23 and 24 in the drawings indicate lock nuts which are attachments of the pressing members and fasten the pressing members in their appropriate rotation positions.

Figure 5:
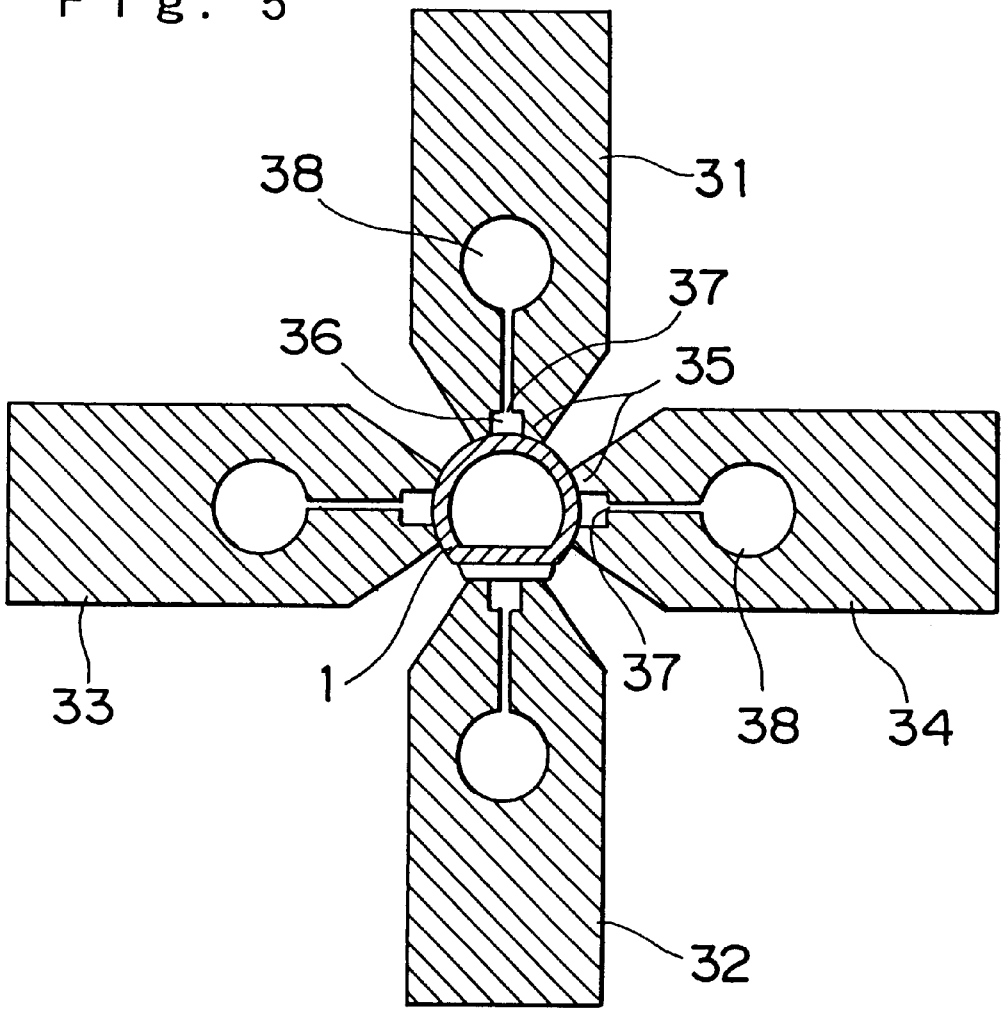
FIG. 5 is a cross-sectional front view at an alternate die portion of an equipment of this invention as a different example of that shown in FIG. 3.

The equipment shown in FIG. 1, FIG. 3 and FIG. 4 is one example of this invention, therefore this invention is not restricted to such an embodiment. For instance, instead of having the upper die 11 and the lower die 12 in FIG. 3, four dies 31, 32, 33 and 34 as shown in FIG. 5 which press along vertical and horizontal directions can be used. Because this equipment can control a pressing force along not only a vertical direction but also a horizontal direction, warping can be prevented more efficiently. Moreover, in the pressing device including two dies as in FIG. 3, a workpiece may happen to be difficult to take out by fitting in the dies, however, the pressing device in FIG. 5 does not have such a problem. In the pressing device shown in FIG. 5, a cross-sectional side view is practically the same as FIG. 1, therefore it is not shown again. Also similar to FIG. 1 and FIG. 3, 35 are projections, 36 are recesses, 37 are cooling liquid spouting holes and 38 are cooling liquid supplying rooms in FIG. 5.

Moreover, in a workpiece of some shape, a direction of warping is not only vertical because of its symmetry unlike the aforementioned rack bar. In this instance., pressing members should push the workpiece along another direction within a direction perpendicular to the length of the workpiece. In the case where dies are composed of the vertical and horizontal four dies 31, 32, 33 and 34 as shown in FIG. 5, pressure can be exerted in any direction by providing a pressing member to each of the four dies as similar to FIG. 4, though they are not shown in a drawing again. Namely, pressure can be exerted not only toward vertical and horizontal directions which are pressing directions of each pressing member, but also in a slant direction by a combination of pressing by the vertical and horizontal pressing members.

Figure 6:
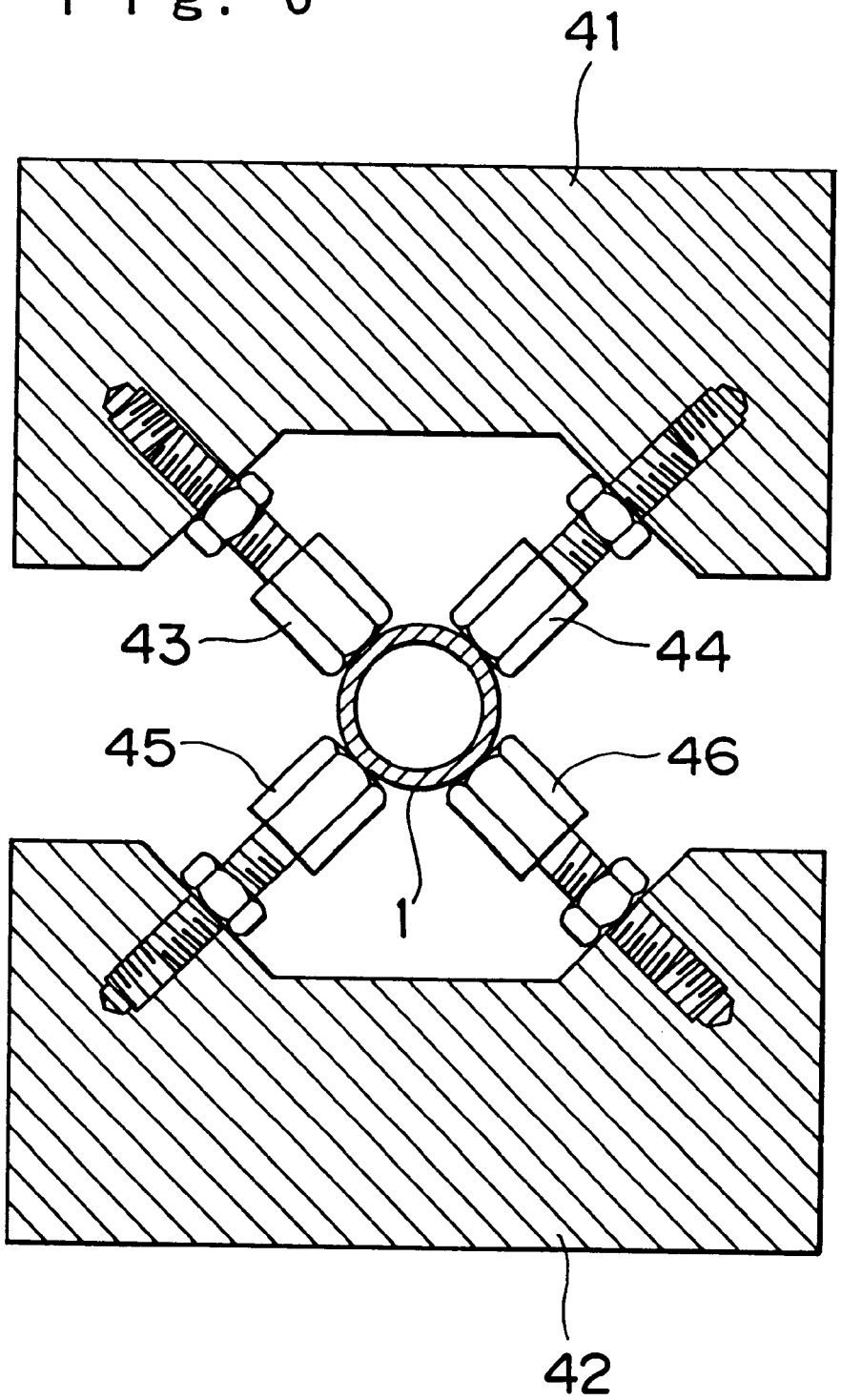
FIG. 6 is a cross-sectional front view of a pressing means of this invention as a different example of that shown in FIG. 4.

In the case in which the dies are composed of upper and lower dies as shown in FIG. 3, pressing means can be designed to exert pressure not only in a vertical direction as shown in FIG. 4, but also in other directions. FIG. 6 is a cross-sectional front view of an example of such a pressing means wherein a workpiece is shown in perpendicular to its length. Namely, 41 and 42 in this drawing are an upper die and a lower die, respectively, and two pressing members among 43, 44, 45 and 46 are connected to each of the dies. Because these pressing members can press the workpiece 1 in different directions 90 degrees apart, they can press in any direction by exerting one or two of the pressing members.

Figure 7:
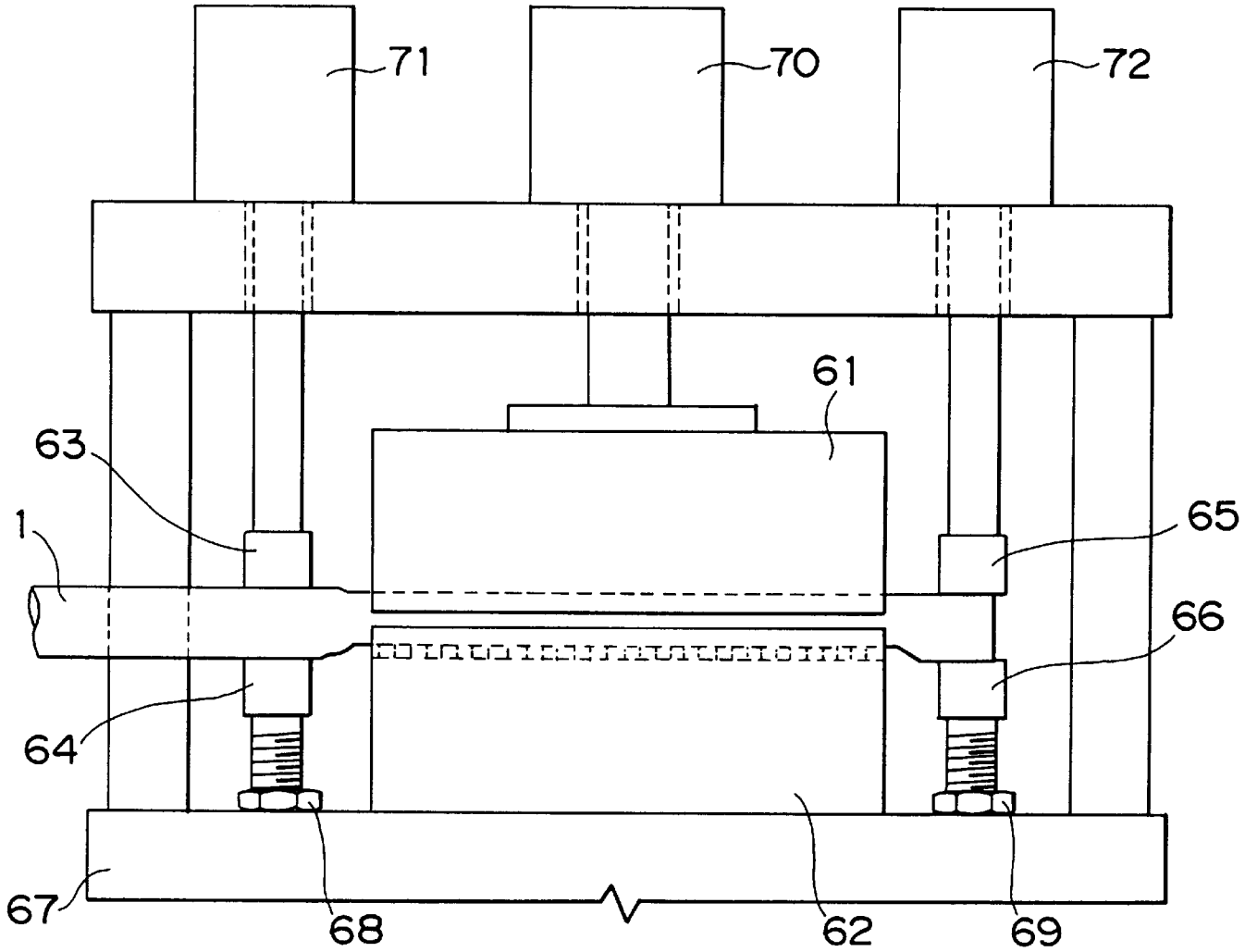
FIG. 7 is a side view of another example of this invention.

In the aforementioned constraining hardening apparatus of the present invention, the pressing device is connected to the dies. However, the pressing members can be provided apart from the dies. FIG. 7 is a side view of an example of such an apparatus where pressing members are installed adjacent to both sides of the workpiece section constrained in the dies 61 and 62, wherein the pressing members comprise pressing members 63, 64, 65 and 66 and other parts which press the workpiece in a direction perpendicular to its longitudinal direction, namely, in a vertical direction in this example. The pressing members 64 and 66 which are located on the lower side are screwed into a supporting base 67 to which the lower die 62 is mounted, so that their vertical positions can be controlled. Besides, 68 and 69 in the drawing are rock nuts. On the other hand, the pressing members 63 and 65 which are located on the upper side are connected to hydraulic cylinders 71 and 72 so as to be pressed against the workpiece 1.

Accordingly, for controlling a pressing stroke using the above pressure regulating means, when pressing the workpiece downwards, the lower pressing members are lowered below a position corresponding to the dies, and then the upper pressing members are pressed by the hydraulic cylinder 71 or 72. On the other hand, when pressing the workpiece upwards, the lower pressing member is raised above a position corresponding to the dies, and then the upper pressing member is retracted to be free. Thus an upward pressing force is yielded as a reaction force by the pressing force of the upper die 61. Reference number 70 in FIG. 7 designates a hydraulic cylinder of the dies.

The apparatus of FIG. 7 in which the pressing members and the dies are separated is more favorable from a standpoint of performance than the aforementioned apparatus in which the pressing members are connected to the dies, although the apparatus becomes complicated. That is, in the apparatus where the pressing members are connected to the dies, rigidity of the dies should be sufficiently high not to be distorted, because the pressing force by the pressing members is sometimes considerably higher than the pressing force of the dies themselves, i.e., higher than the pressing force against the hardening part. However, the apparatus of FIG. 7 where the pressing members and the dies are separated does not have such a problem. Moreover, because the pressing members and the dies are separated, the degrees of freedom during operation are high because the pressing members can be operated independently from the dies. In other words, the direction and magitude of the forces generated by the pressing members can be determined more freely.

In the above explanation of FIG. 7, the pressure regulating means act to control the pressing stroke of the pressing members similar to the aforementioned example in FIG. 1. However, when pressing the workpiece downwards in FIG. 7, a pressing force can be controlled as another pressure regulating method, wherein the lower pressing member 64 or 66 is retracted to be free. Then the upper pressing member 63 or 65 is pressed by the hydraulic cylinder 71 or 72 in an appointed force. Moreover, in the apparatus in FIG. 7, another pressure regulating means can be adopted wherein hydraulic cylinders are provided to all of the pressing members including the lower pressing members 64 and 66 for controlling pressing forces by hydraulic pressure. Consequently, in this case, at least one of the pressing stroke and the pressing force is controlled by the pressure regulating means at each of the pressing members.

In addition, in the example shown in FIG. 7, the pressing members exert pressure only in a vertical direction. However, it is a matter of course that pressing members of horizontal direction can be added in case of necessity. On the other hand, any of the four pressing members 63, 64, 65 and 66 shown in FIG. 7 can be omitted from the apparatus under some conditions. Moreover, though the dies in FIG. 7 are a set of upper and lower dies, a set of four dies can be adopted as shown in FIG. 5.

As for an operating method of the pressing device in the constrained hardening apparatus of this invention, occurrence of warping is minimized by exerting stress for extinguish strain arisen in the workpiece, as mentioned before. Namely, when a completely straight workpiece is held in the dies and projections of the pressing members are just touching the workpiece, a pressing force is exerted only if the workpiece bends in a direction to be pushed by the pressing members. If the workpiece is completely straight, a pressing force is no longer exerted. However, from a standpoint of effect, it is the same as if the inner faces of the dies extended along a length of the workpiece instead of the pressing members. Such a method is not denied in this invention because this method may be effective in some conditions depending on a shape of the workpiece. However, the effect of this invention is exhibited by protruding the pressing members so that the workpiece can be bent elastically, even if a straight workpiece is held between the dies. That is, although the workpiece is bending while being held between the dies at the end of a quenching process, a straight product can be obtained by opening the dies and releasing the constraining force, so as to cancel strain caused by residual stress.

FIG. 8(*a*) to FIG. 8(*d*) are drawings for explaining the effect of the constrained hardening method of this invention, wherein a workpiece is shown schematically as viewed from its side. Here the workpiece 51 represents an imaginary odd-shaped workpiece not restricted to that shown in FIG. 2, wherein the workpiece is quenched while being constrained by the dies 52 and 53. For instance, when upward pressing forces are exerted by the pressing members 55 and 57 at both sides of the dies 52 and 53 as shown in FIG. 8(*a*), a bending force as shown by the arrows in FIG. 8(*b*) acts on the workpiece. Naturally, if the pressing forces are inverse to the above by using the pressing members 54 and 56, the direction of bending is inverse to the above. The method for using pressing members as in FIG. 8(*a*) and FIG. 8(*b*) is effective for the odd-shaped workpiece as shown in FIG. 2, because this workpiece has a tendency to warp and curve in one direction.

On the other hand, when mutually reverse pressing forces are exerted by the pressing members 55 and 56 at both sides of the dies 52 and 53 as shown in FIG. 8(*c*), a bending force as shown by the arrows in FIG. 8(*d*) can be applied to the workpiece. Moreover, of course, a pressing member only at one side of the dies can be exerted. Therefore, bending forces suitable in accordance with the shape of odd-shaped workpieces can be exerted by such combination of directions of pressing forces by the pressing members.

As explained above, the pressing means used in the constrained hardening apparatus of this invention can be controlled in pressing conditions variously in accordance with a tendency for occurrence of quench warping in the workpiece. Then here arises a problem of how to determine the pressing stroke and so on in practical constrained quenching procedures. This invention has a premise to deal with many workpieces of the same shape, and during the process, dies are used which have a contour of the workpiece. Accordingly, by executing quenching while successively varying conditions of the pressing means by trial and error, conditions for minimizing warping of the products can be determined as a result. However, as a more rational method, it is recommended that test quenching is executed with all pressing means being retracted from the workpiece so that the workpiece is constrained only by dies. Then proper quenching is executed by setting the pressing means in a pressing direction and in a pressing stroke or pressing force so as to reform the bend that occurs in the test quenching. Though the bend in the workpiece after hardening cannot always be minimized by one test quenching, an optimum condition can be found by slight additional control.

EXAMPLE

Hardening of the rack part of a workpiece having a rack gear along a part of a pipe side as shown in FIG. 2 was executed. The material was equivalent to JIS S40C which is carbon steel for mechanical structures. As for approximate dimensions of the workpiece, an outer diameter and an inner diameter of the pipe were, respectively, 23 mm and 19 mm at the short full-circle part 4, and the deformed part is formed as the rack 3 to be a waned circle in a cross section. Lengths of the short full-circle part and the deformed part were 30 mm and 270 mm, respectively. In addition, a length of the part where the rack is actually formed was 180 mm. With respect to the fill-circle part 2, it was 25 mm in outer diameter, 21 mm in inner diameter and 450 mm in length.

The deformed part 3 of the above-mentioned workpiece was heated to a hardening temperature of 950° C. by an induction heating coil, but a portion near the end of the short full-circle part 4 was not included in the heating region. Then it was quenched by a jet of cooling water while a pressing force was exerted between the dies shown in FIG. 1 and FIG. 3. The pressing force was equal to an elasticity limit stress of 950° C. of the workpiece so as not to be collapsed. At this time, the pressing members 17, 18, 19 and 20 which were at both sides of the dies were retracted to be separated from the workpiece.

After the above-mentioned hardening, bending was measured to be 2.3 mm, whereby the workpiece was rotated with both ends being supported on knife edges, and deflection was measured by a dial gauge at a point midway between both ends. The reasons for bending are because strain could not be suppressed because of restriction of the pressing force within an elasticity limit stress at 950° C., and because residual stress was created by an asymmetric cooling rate due to the odd-shaped workpiece. The bending at that time appeared at the side with the rack being inside.

Then, hardening was executed by using the pressing means shown in FIG. 1 and FIG. 4, whereby protrusion of the lower pressing members 18 and 20 was 0.2 mm and 0.3 mm, respectively, at the longer full-circle side 18 and the shorter full-circle side 20. The other conditions such as heating temperature and the pressing force applied by the dies were the same as in the former case. As a result, bending was so small to be 0.04 mm, so that the remarkable effect of this invention can be seen.

As above explained, the constrained hardening method of the odd-shaped bar workpiece in this invention is able to prevent occurrence of warping in quenching which is difficult to prevent completely in prior constrained quenching processes by dies, because of residual stress, limitation of a pressing force to a hollowed workpiece and so on. Therefore warping by quenching can almost be prevented in mass production of odd-shaped members such as an automobile steering rack bar. This invention is not restricted to the embodiments above explained with the drawings. This invention may be changed or modified in other forms without departing from the spirit or essential characteristic thereof and without diminishing its attendant advantages. Therefore such changes and modifications are covered by the appended claims.

What is claimed is:

1. A hardening method comprising:

heating a first section of a workpiece;

constraining the first section of the workpiece between a set of dies; the workpiece having at least one adjacent second section located adjacent to the first section with respect to a longitudinal axis of the workpiece; and quenching the constrained workpiece while pressing at least one of the at least one adjacent second section of the workpiece in a direction orthogonal to the longitudinal axis of the workpiece using a pressing mechanism, wherein the pressing mechanism contacts the at least one of the at least one adjacent second section of the workpiece.

2. The hardening method of claim 1, further comprising:

test quenching after said constraining of the workpiece between the set of dies and before said quenching of the constrained workpiece, wherein said test quenching comprises quenching while the pressing mechanism is retracted from the workpiece so that the pressing mechanism does not contact and press against the workpiece during said test quenching.

3. The hardening method of claim 1, wherein the pressing mechanism includes a plurality of pressing members, said quenching of the constrained workpiece comprises individually adjusting a pressing force of each of the plurality of pressing members so as to press the at least one of the at least one adjacent second section of the workpiece.

4. The hardening method of claim 3, wherein each of the plurality of pressing members has a threaded portion, said individually adjusting a pressing force of each of the plurality of pressing members comprising rotating the threaded portion of each of the plurality of pressing members so as to adjust a height of each of the plurality of pressing members.

5. A hardening apparatus comprising:

a set of dies for constraining a section of a workpiece to be quenched by contacting a clamped section of the workpiece;

at least one pressing member for contacting the workpiece at at least one adjacent section of the workpiece, the at least one adjacent section being located adjacent to the clamped section with respect to a longitudinal axis of the workpiece, and for pressing the at least one adjacent section of the workpiece in a direction orthogonal to the longitudinal axis of the workpiece; and a pressure regulating mechanism connected to each of said at least one pressing member for regulating at least one of a pressing stroke and a pressing force of each of said at least one pressing member independently of a pressing condition of said set of dies.

6. The hardening apparatus of claim 5, wherein each of said set of dies has a plurality of projections defining a contour of each of said dies corresponding to a contour of the clamped section of the workpiece to be contacted by said set of dies, wherein recesses are formed between said plurality of projections, and wherein a liquid spouting hole opens into at least one of said recesses.

7. The hardening apparatus of claim 6, wherein each of said set of dies includes a cooling liquid supply room, said liquid spouting hole being arranged to connect said cooling liquid supply room and said at least one of said recesses.

8. A hardening apparatus comprising:

a set of dies for constraining a section of a workpiece to be quenched by contacting a clamped section of the workpiece;

at least one pressing member connected to at least one of said set of dies for contacting the workpiece at at least one adjacent section of the workpiece, the at least one adjacent section being located adjacent to the clamped section with respect to a longitudinal axis of the workpiece, and for pressing the at least one adjacent section of the workpiece in a direction orthogonal to the longitudinal axis of the workpiece; and a position regulating mechanism between each of said set of dies and each of said at least one pressing member for regulating a pressing stroke of each of said at least one pressing member.

9. The hardening apparatus of claim 8, wherein each of said set of dies has a plurality of projections defining a contour of each of said dies corresponding to a contour of the clamped section of the workpiece to be contacted by said set of dies, wherein recesses are formed between said plurality of projections, and wherein a liquid spouting hole opens into at least one of said recesses.

10. The hardening apparatus of claim 9, wherein each of said set of dies includes a cooling liquid supply room, said liquid spouting hole being arranged to connect said cooling liquid supply room and said at least one of said recesses.

11. A method for measuring pulsus paradoxus in a patient comprising the steps of:

obtaining the data indicative of pulsatile cardiovascular behavior from said patient;

extracting data indicative of respiration from the pulsatile cardiovascular behavior data;

extracting data indicative of pulse from the pulsatile cardiovascular behavior data;

employing period amplitude analysis to said extracted pulse data and said extracted respiration data; and generating data indicative of presence of pulses paradoxus in said patient from said period amplitude analysis.

12. The hardening apparatus of claim 11, wherein each of said set of dies has a plurality of projections defining a contour of each of said dies corresponding to a contour of the clamped section of the workpiece to be contacted by said set of dies, wherein recesses are formed between said plurality of projections, and wherein a liquid spouting hole opens into at least one of said recesses.

13. The hardening apparatus of claim 12, wherein each of said set of dies includes a cooling liquid supply room, said liquid spouting hole being arranged to connect said cooling liquid supply room and said at least one of said recesses.

* * * * *